US007384298B2

(12) United States Patent
Caveney et al.

(10) Patent No.: US 7,384,298 B2
(45) Date of Patent: Jun. 10, 2008

(54) WIRE CONTAINMENT CAP

(75) Inventors: Jack E. Caveney, Hinsdale, IL (US); Michael V. Doorhy, Mokena, IL (US); Masud Bolouri-Saransar, Orland Park, IL (US); Satish I. Patel, Roselle, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 11/462,204

(22) Filed: Aug. 3, 2006

(65) Prior Publication Data

US 2007/0032137 A1 Feb. 8, 2007

Related U.S. Application Data

(60) Provisional application No. 60/706,370, filed on Aug. 8, 2005.

(51) Int. Cl.
*H01R 4/24* (2006.01)

(52) U.S. Cl. ..... 439/404; 439/941; 439/676

(58) Field of Classification Search ..... 439/676, 439/404

See application file for complete search history.

(56) References Cited

U.S. PATENT DOCUMENTS

| | | | | |
|---|---|---|---|---|
| 4,516,822 | A | 5/1985 | Wolfel | |
| 6,056,586 | A * | 5/2000 | Lin | 439/460 |
| 6,077,122 | A * | 6/2000 | Elkhatib et al. | 439/608 |
| 6,238,235 | B1 | 5/2001 | Shavit et al. | |
| 6,267,617 | B1 | 7/2001 | Nozick | |
| 6,338,641 | B2 | 1/2002 | Nicholls | |
| 6,338,642 | B2 | 1/2002 | Nicholls | |
| 6,338,655 | B1 | 1/2002 | Masse et al. | |
| 6,592,396 | B2 * | 7/2003 | Pepe et al. | 439/417 |
| 6,702,617 | B1 * | 3/2004 | Clement et al. | 439/608 |
| 6,746,283 | B2 * | 6/2004 | Arnett et al. | 439/676 |
| 6,854,998 | B2 * | 2/2005 | Yuan | 439/404 |
| 6,953,362 | B2 | 10/2005 | Mossner et al. | |
| 7,025,621 | B2 * | 4/2006 | Mossner et al. | 439/395 |
| 7,114,987 | B2 | 10/2006 | Nad | |
| 2005/0106929 | A1 | 5/2005 | Meckley et al. | |
| 2005/0136747 | A1 | 6/2005 | Caveney et al. | |

FOREIGN PATENT DOCUMENTS

| | | | |
|---|---|---|---|
| EP | 1014498 | A2 | 6/2000 |
| WO | 01/43239 | A1 | 6/2001 |

* cited by examiner

*Primary Examiner*—Neil Abrams
*Assistant Examiner*—Harshad C Patel
(74) *Attorney, Agent, or Firm*—Robert A. McCann; Zachary J. Smolinski

(57) ABSTRACT

A wire containment cap has twisted pair slots for routing twisted wire pairs through the wire containment cap. The twisted pair slots are provided with funnel-shaped entrances to assist in routing the twisted wire pairs from a rear end of the wire containment cap toward wire slots of the wire containment cap. The wire containment cap may be provided in shielded or unshielded versions, and is adapted for use with a communication jack assembly.

24 Claims, 18 Drawing Sheets

WIRE CONTAINMENT CAP

CROSS-REFERENCE TO RELATED APPLICATIONS

This application claims the benefit of U.S. Provisional Patent Application No. 60/706,370 filed Aug. 8, 2005. This application incorporates by reference in their entireties U.S. Provisional Patent Application No. 60/598,640 filed Aug. 4, 2004; U.S. Provisional Patent Application No. 60/636,972 filed Dec. 17, 2004; and U.S. Provisional Patent Application No. 60/637,247 filed Dec. 17, 2004.

FIELD OF THE INVENTION

The present invention relates generally to electrical connectors, and more particularly, to a modular communication jack design with an improved wire containment cap.

BACKGROUND OF THE INVENTION

In the communications industry, as data transmission rates have steadily increased, crosstalk due to capacitive and inductive couplings among the closely spaced parallel conductors within the jack and/or plug has become increasingly problematic. Modular connectors with improved crosstalk performance have been designed to meet the increasingly demanding standards. Many of these connectors have addressed crosstalk by compensating at the front end of the jack, i.e., the end closest to where a plug is inserted into the jack. However, the wire pairs terminated to the insulation displacement contact ("IDC") terminals at the rear portion of a jack may also affect the performance of the jack.

One problem that exists when terminating wire pairs to the IDC terminals of a jack is the effect that termination has on the crosstalk performance of a jack. When a twisted-pair cable with four wire pairs is aligned and terminated to the IDC terminals of a jack, a wire pair may need to flip over or under another wire pair. An individual conductor of a wire pair may also be untwisted and orientated closely to a conductor from a different wire pair. Both of these conditions may result in unintended coupling in the termination area which can degrade the crosstalk performance of the jack. Thus, a solution addressing the crosstalk in the termination area of the jack would be desirable.

A second problem that exists when terminating wire pairs to the IDC terminals of a jack is variability. A technician is typically called on to properly terminate the wire pairs of a twisted pair cable to the proper IDC terminals of the jack. Each jack terminated by the technician should have similar crosstalk performance. This requires the termination to remain consistent from jack to jack. However, different installers may use slightly different techniques to separate out the wire pairs and route them to their proper IDC terminals. Thus, a solution that controls the variability of terminations from jack to jack would be desirable.

A final issue that arises when terminating wire pairs to the IDC terminals of a jack is the difficulty of the termination process. Typical jacks provide little assistance to the technician, resulting in occasional misterminations (e.g. a wire being terminated at an incorrect location in the jack). Even if detailed instructions are provided with the jack, technicians may not read these instructions prior to installing the jacks. Furthermore, a jack with a difficult termination process can increase the installation time for the technician and result in a costly installation for the customer. Thus, a jack solution that simplifies the termination process and minimizes the possibility of technician error would be desirable.

SUMMARY

The present application meets the shortcomings of the prior art by providing a wire containment cap having a first side including a plurality of retainers for retaining wires, a second side being opposite the first side, two sidewalls extending between the first side and the second side, and wire pair holes or slots between the first side and the second side.

A communication jack assembly is also described. The communication jack comprises a front portion including a retention clip, and a wire containment cap including a retention recess for securing the wire containment cap to the front portion. The wire containment cap comprises a first side including a plurality of retainers for retaining wires, a second side being opposite the first side, two sidewalls extending between the first side and the second side, and wire pair holes or slots between the first side and the second side.

Wire containment caps and communication jack assemblies according to the present invention may be provided in shielded or unshielded embodiments. Further, the second side of wire containment caps according to the present invention may be provided with a slot and other features allowing for the use of an integral strain relief clip.

DETAILED DESCRIPTION OF THE PREFERRED EMBODIMENTS

Figure 1:
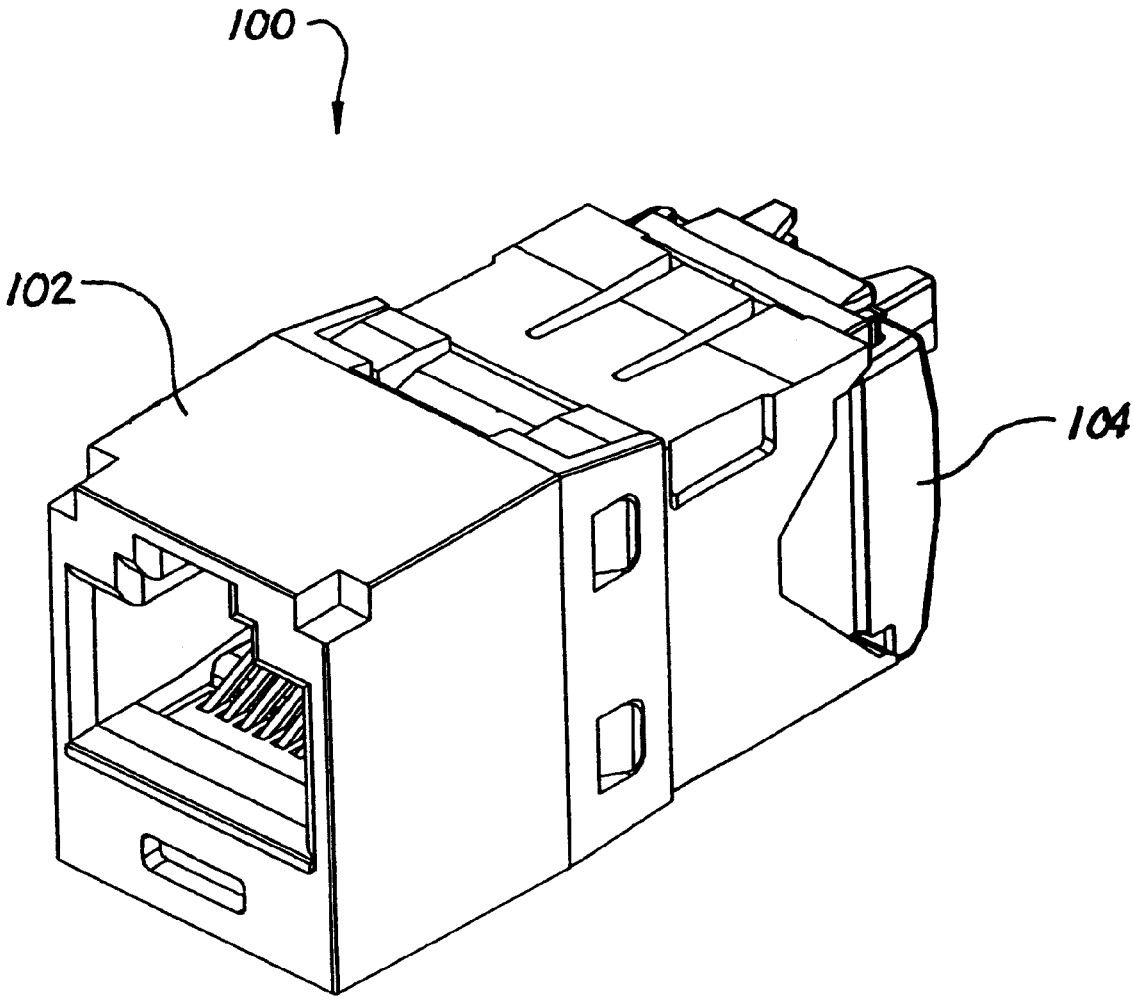
FIG. 1 is a front upper right perspective view of a communication jack having a wire containment cap in accordance with an embodiment of the present invention.

FIG. 1 is a front upper right perspective view of a communication jack 100 according to one embodiment of the present invention. The communication jack 100 includes a front portion 102 and a wire containment cap 104. The front portion 102 may include such components as plug interface contacts, a mechanism for coupling the jack to a plug, crosstalk compensation circuitry, and wire-displacement contacts to provide an electrical connection between the jack and a communication cable. Additional details on the wire containment cap 104 are described with reference to FIGS. 3-11, below.

Figure 2:
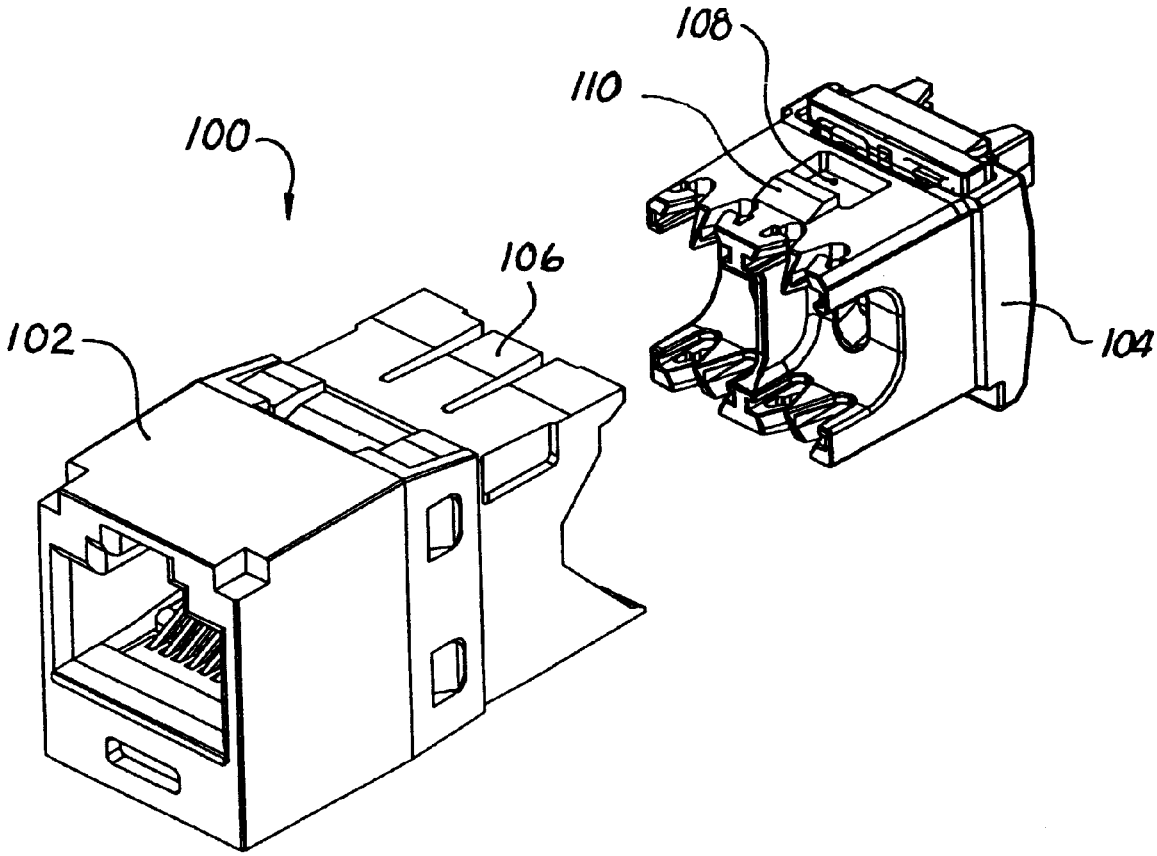
FIG. 2 is a front upper right partially exploded view of the communication jack of FIG. 1.

FIG. 2 is a front upper right partial-exploded view of the communication jack 100 of FIG. 1. In the embodiment shown, the wire containment cap 104 is slidably mounted within the front portion 102. A retention clip 106 on the front portion 102 and a retention recess 108 on the wire containment cap 104 may be included to secure the wire containment cap 104 to the front portion 102. A retention latch 110 is also provided in the embodiment of FIG. 2. Other mounting and securing techniques may also be used.

FIGS. 3-11 illustrate the wire containment cap 104 in further detail. The wire containment cap 104 includes a large opening 112 in the back to allow a cable to be inserted, and allow the pairs to separate in a short distance as they transition toward IDC terminals. The back of the wire containment cap 104 also has a strain relief guide slot 114 and strain relief latch teeth 116 to accommodate a strain relief clip as shown and described in U.S. provisional patent application Ser. No. 60/636,972, filed on Dec. 17, 2004 and entitled "Wire Containment Cap with an Integral Strain Relief Clip." Shoulders 117 are provided on the left and right along the rear of the wire containment cap 104.

Figure 3:
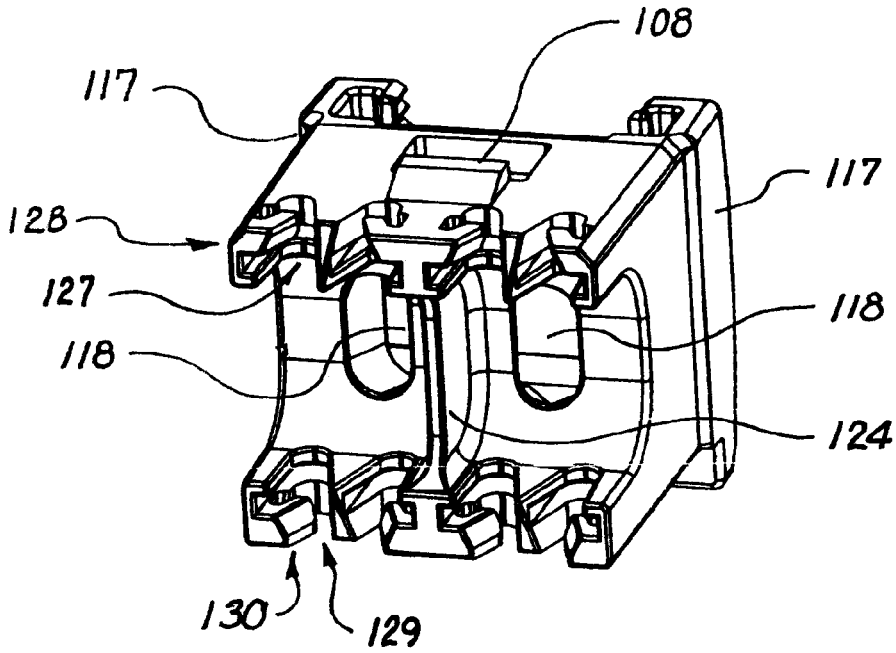
FIG. 3 is a front upper right perspective view of a wire containment cap in accordance with an embodiment of the present invention.
Figure 4:
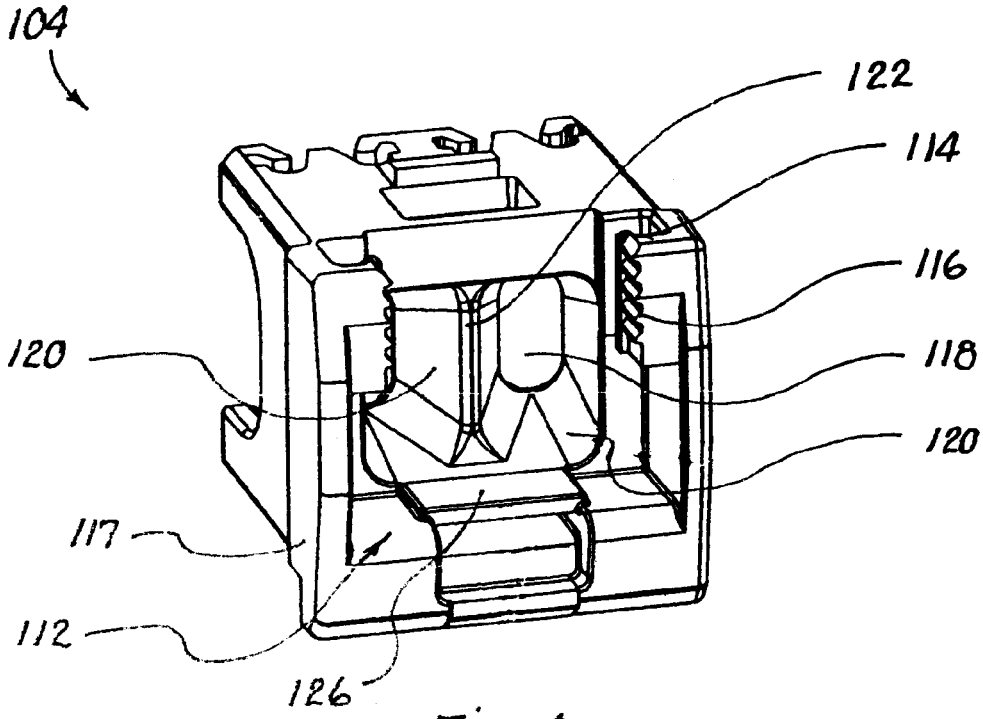
FIG. 4 is a rear upper right perspective view of the wire containment cap of FIG. 3.

The opening 112 provides easy access to two slots 118 having funnel-shaped slot entrances 120. A rear spine 122 separates the slots toward the rear of the wire containment cap 104 and a front spine 124—as shown in FIG. 3—separates wire pairs at the front of the wire containment cap 104. A saddle area 126 serves as a lower support for a cable when the cable is clipped by the strain relief clip.

In a preferred embodiment of the present invention, wires are separated and crossed-over as necessary toward the rear of the wire containment cap 104, before the wires are inserted into the slots 118. The saddle area 126 is sufficiently low and the rear spine 122 is sufficiently offset from the rear end of the wire containment cap 104 to provide an installer with ample room to separate and cross-over or "flip" wire pairs as necessary on the rear sides of the slots 118. One reason this flip may be necessary is because the wire pair layout on one end of a twisted pair cable is a mirror image of the wire pair layout on the opposite end of the twisted pair cable. Another reason this flip may occur is because the Telecommunications Industry Association ("TIA") standards allow structured cabling systems to be wired using two different wiring schemes. Finally, a flip may occur because not all cables have the same pair layout.

To complete the installation, the technician need only place wire pairs through appropriate slots 118, secure individual wire pairs in the upper and lower wire restraints 128 and 130—as shown in FIG. 3—and attach the wire containment cap 104 to the front portion 102 of the communication jack 100.

The slots 118 are preferably sized so that lateral or vertical shifting of wires after the wires have been inserted into the slots 118 is reduced or eliminated. In a preferred embodiment, the wire containment cap 104 is constructed of a plastic material, such as a thermoplastic. Alternative materials, shapes, and subcomponents could be utilized instead of what is illustrated in FIGS. 3-11.

The shoulders 117 serve as support and stopping mechanisms to place the wire containment cap 104 in a correct physical position with respect to the front portion 102 shown in FIGS. 1 and 2. Alternative support and/or stopping mechanisms could also be used, such as one located on the front portion 102, or on the wire containment cap 104 in such a position that it abuts an interior location in the front portion 102, rather than the exterior abutment shown in FIGS. 1 and 2.

Figure 5:
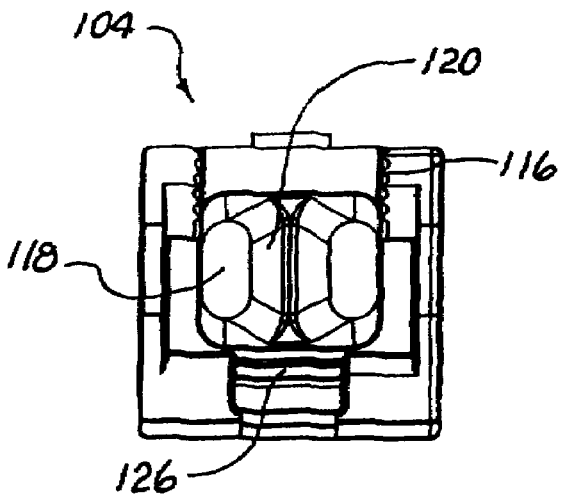
FIG. 5 is a rear view of the wire containment cap of FIG. 3.

Additional details of the wire containment cap 104 are shown in FIGS. 5-11. FIG. 5 is a rear view of the wire containment cap 104 showing the slots 118 and the funnel-shaped slot entrances 120.

Figure 6:
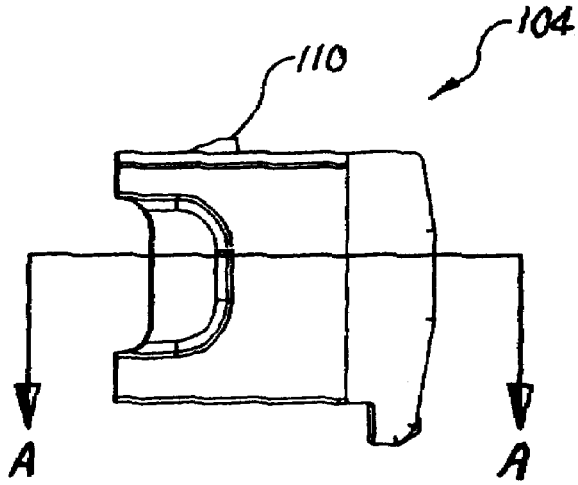
FIG. 6 is a right-side view of the wire containment cap of FIG. 3.

FIG. 6 is a right-side view of the wire containment cap 104.

Figure 7:
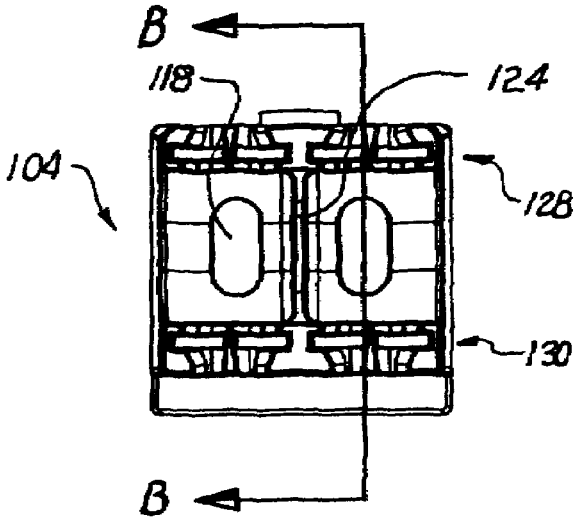
FIG. 7 is a front view of the wire containment cap of FIG. 3.

FIG. 7 is a front view of the wire containment cap 104 showing the slots 118, the front spine 124, and the upper and lower wire restraints 128 and 130.

Figure 8:
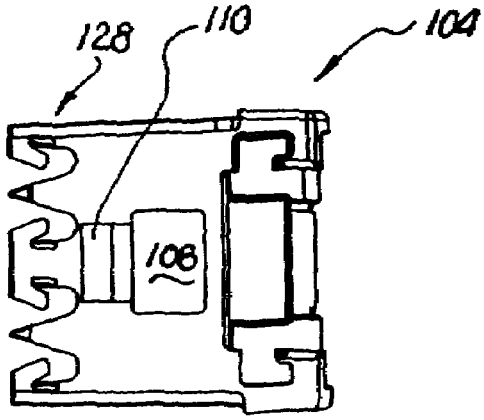
FIG. 8 is a top view of the wire containment cap of FIG. 3.

FIG. 8 is a top view of the wire containment cap 104 showing the retention recess 108, the retention latch 110, and the upper wire restraints 128.

Figure 9:
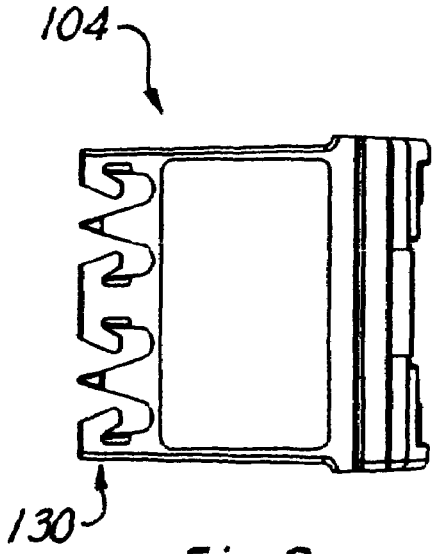
FIG. 9 is a bottom view of the wire containment cap of FIG. 3.

FIG. 9 is a bottom view of the wire containment cap 104 showing the lower wire restraints 130.

Figure 10:
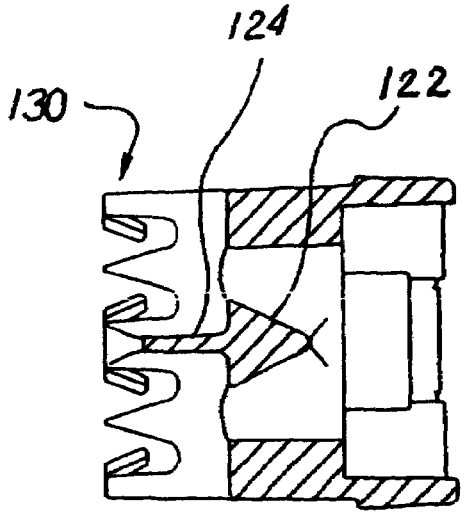
FIG. 10 is a cross-sectional view taken along the line A-A of FIG. 6.
Figure 10A:
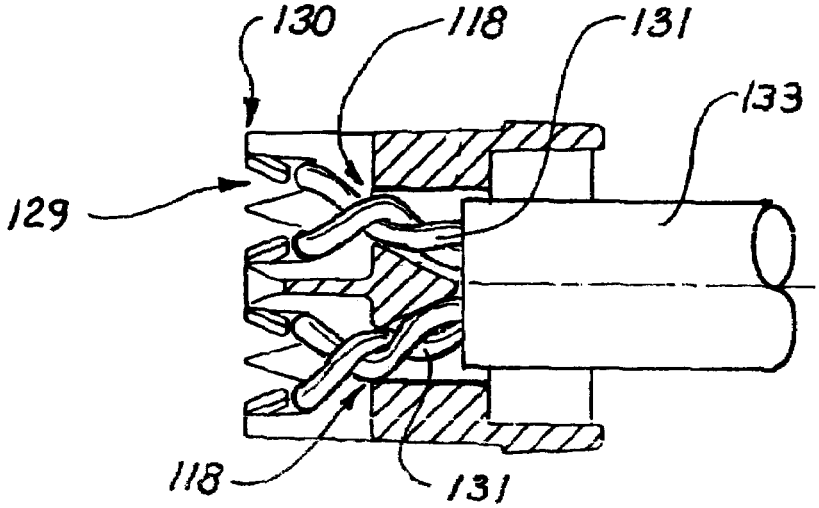
FIG. 10*a* is the cross-sectional view of FIG. 10 further showing a cable and twisted wire pairs of the cable.

FIG. 10 is a cross-sectional view of the wire containment cap 104 along the line A-A of FIG. 6. The rear spine 122 and the front spine 124 are visible, as are the lower wire restraints 130. FIG. 10*a* shows the cross-sectional view of FIG. 10 further illustrating twisted wire pairs 131 emerging from a cable 133 and routed through the twisted-pair slots 118.

Figure 11:
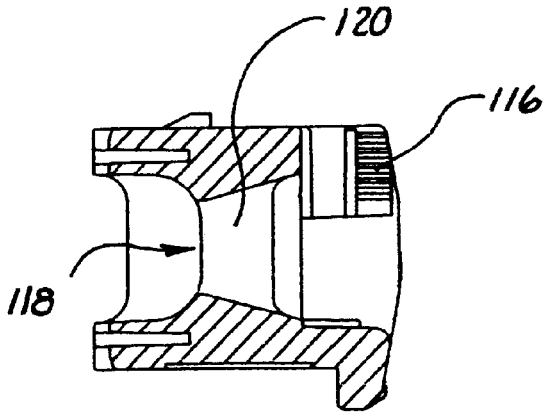
FIG. 11 is a cross-sectional view taken along the line B-B of FIG. 7.
Figure 11A:
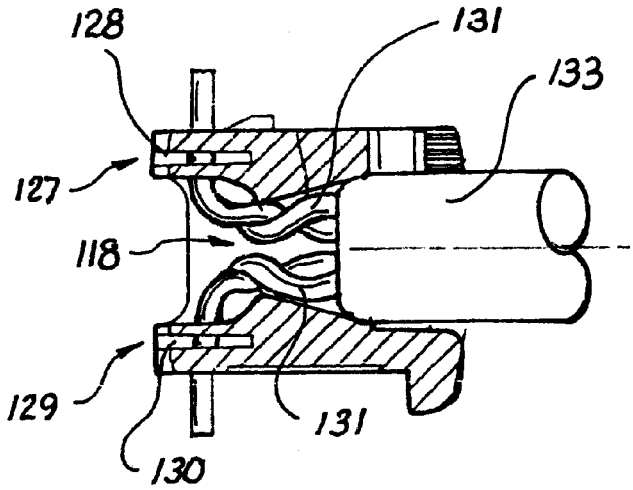
FIG. 11*a* is the cross-sectional view of FIG. 11 further showing a cable and twisted wire pairs of the cable.
Figure 11B:
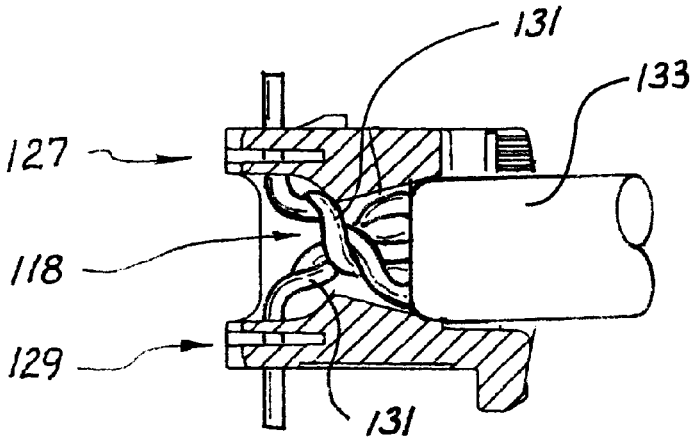
FIG. 11*b* is the cross-sectional view of FIG. 11 further showing a cable and crossed-over twisted wire pairs of the cable.

FIG. 11 is a cross-sectional view of the wire containment cap 104 along the line B-B of FIG. 7, showing a slot 118 and its funnel-shaped entrance 120. The strain relief latch teeth 116 are also visible in FIG. 11. FIG. 11*a* shows the cross-sectional view of FIG. 11 further illustrating twisted wire pairs 131 emerging from a cable 133 and routed through the twisted-pair slot 118 toward the upper and lower wire slots 127 and 129. FIG. 11*b* is similar to FIG. 11*a*, but illustrates twisted wire pairs 131 that are crossed over within the twisted-pair slot 118 and routed toward opposite wire slots 127 and 129.

Figure 12:
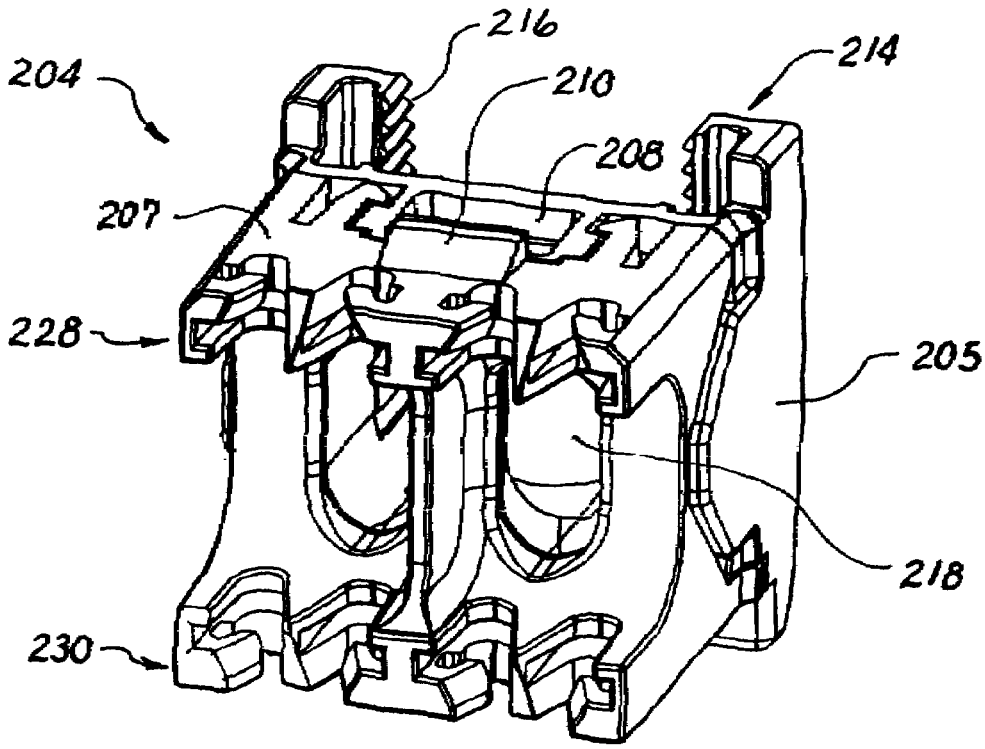
FIG. 12 is a front upper right perspective view of a shielded wire containment cap according to one embodiment of the present invention.
Figure 13:
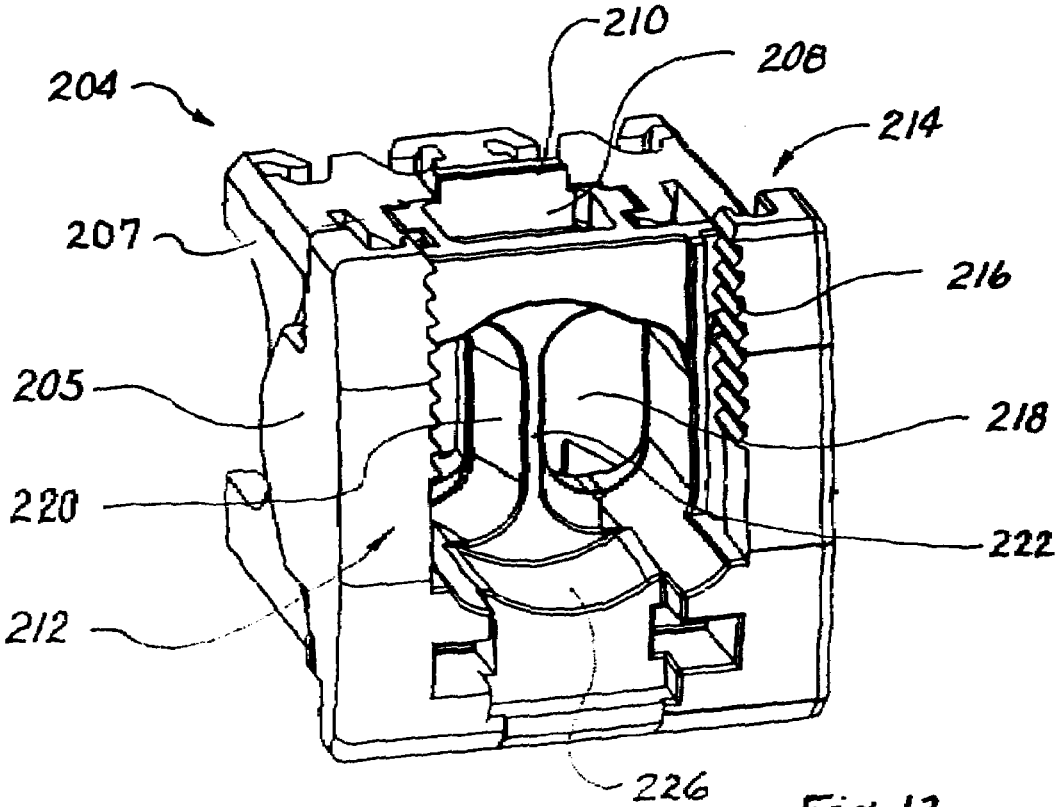
FIG. 13 is a rear upper right perspective view of the wire containment cap of FIG. 12.
Figure 14:
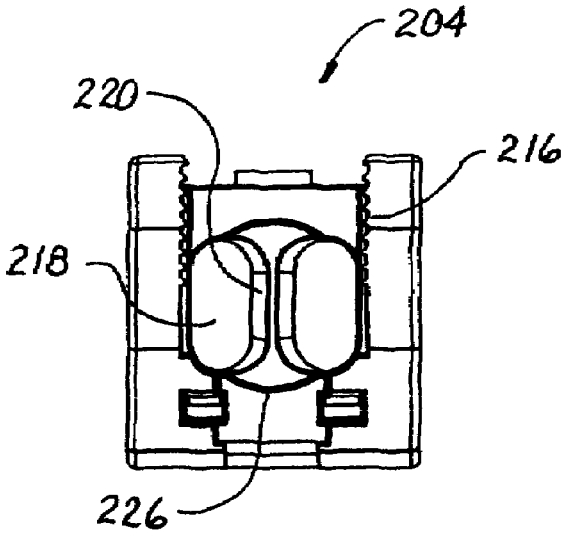
FIG. 14 is a rear view of the wire containment cap of FIG. 12.
Figure 15:
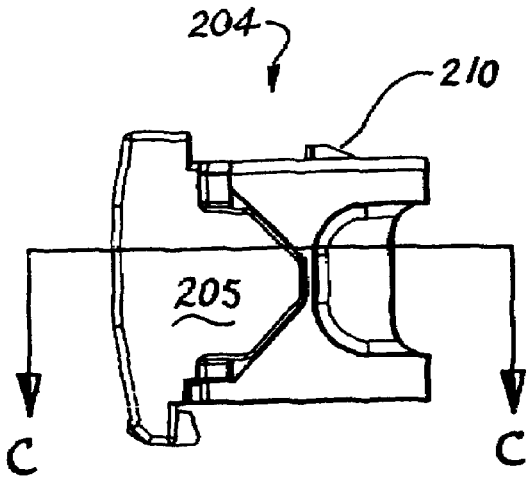
FIG. 15 is a left-side view of the wire containment cap of FIG. 12.
Figure 16:
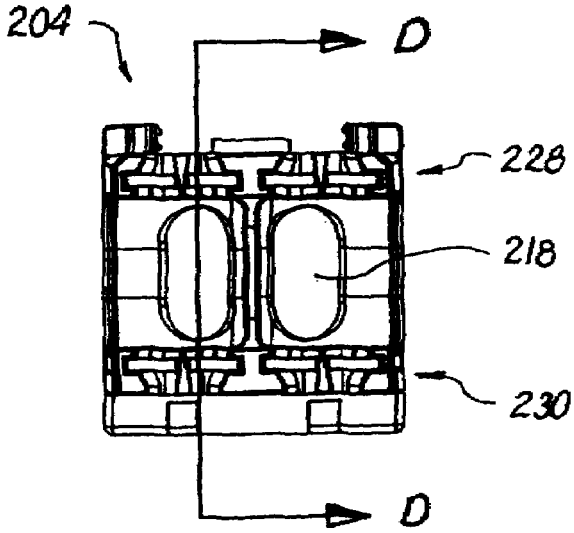
FIG. 16 is a front view of the wire containment cap of FIG. 12.
Figure 17:
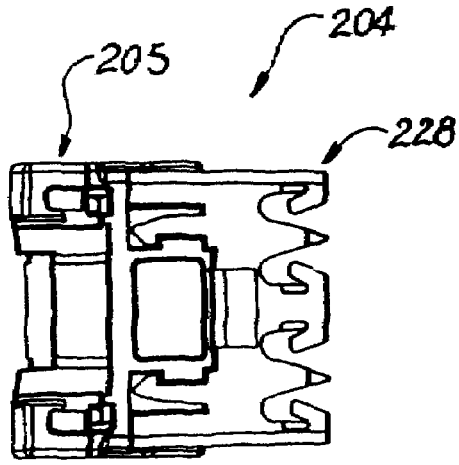
FIG. 17 is a top view of the wire containment cap of FIG. 12.
Figure 18:
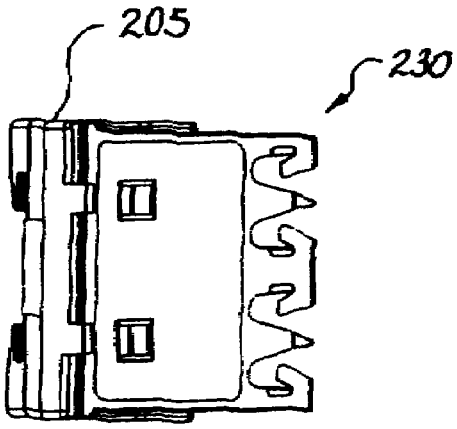
FIG. 18 is a bottom view of the wire containment cap of FIG. 12.
Figure 19:
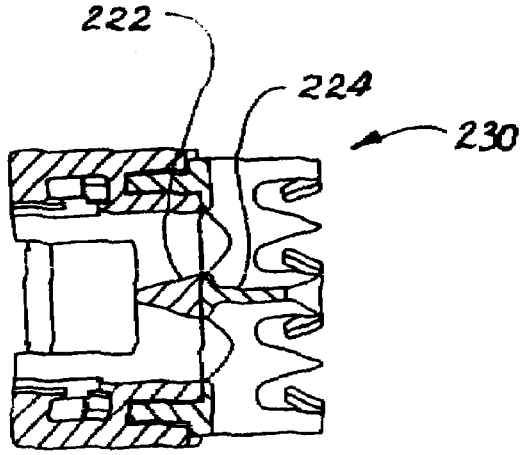
FIG. 19 is a cross-sectional view taken along the line C-C of FIG. 15.
Figure 20:
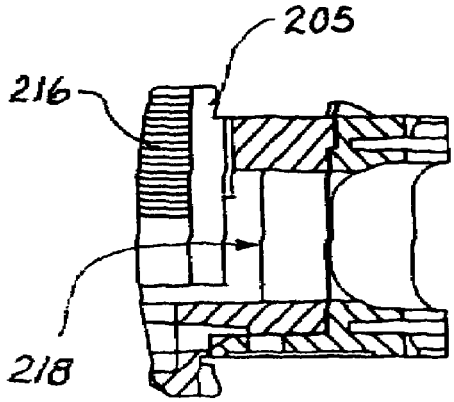
FIG. 20 is a cross-sectional view taken along the line D-D of FIG. 16.
Figure 21:
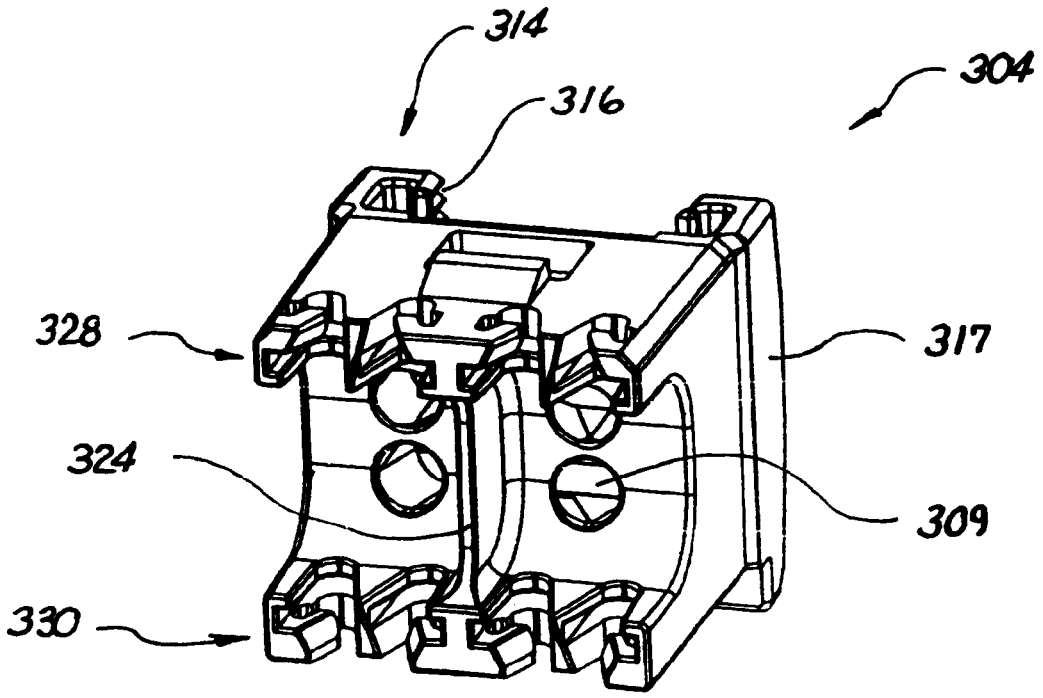
FIG. 21 is a front upper right perspective view of a wire containment cap according to one embodiment of the present invention.
Figure 22:
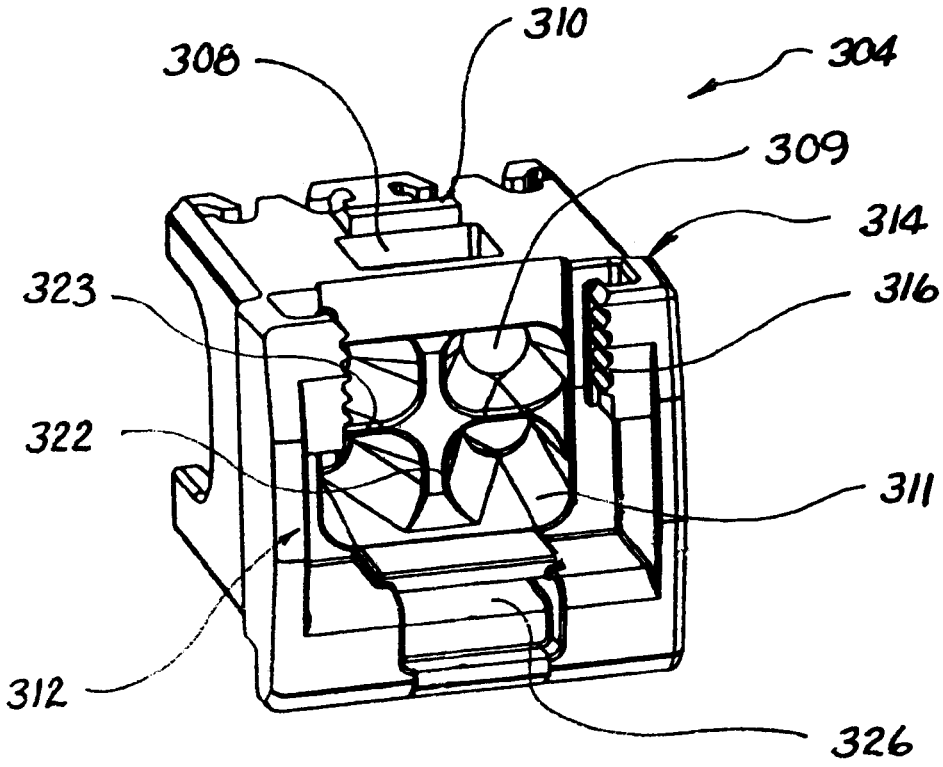
FIG. 22 is a rear upper right perspective view of the wire containment cap of FIG. 21.
Figure 23:
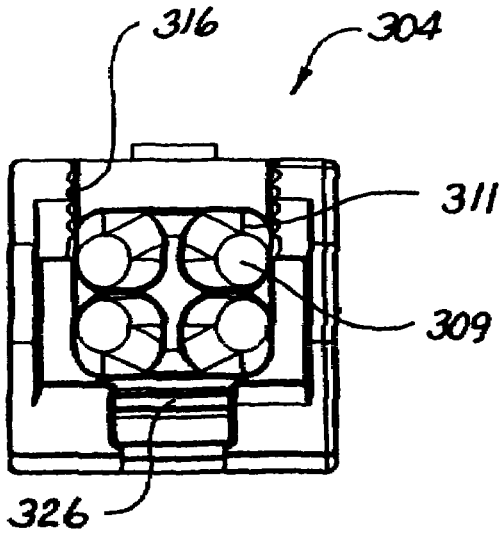
FIG. 23 is a rear view of the wire containment cap of FIG. 21.
Figure 24:
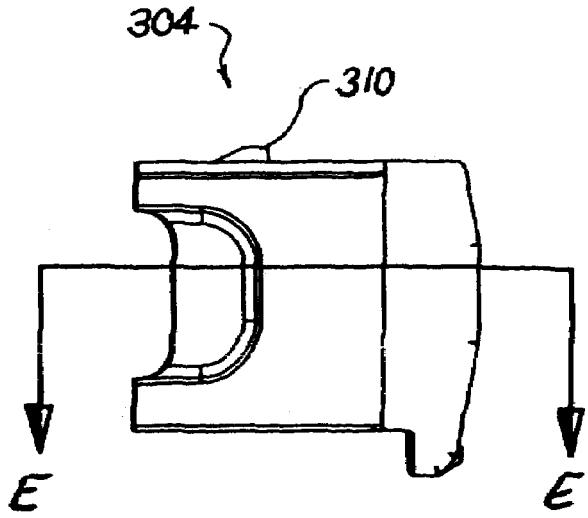
FIG. 24 is a right-side view of the wire containment cap of FIG. 21.
Figure 25:
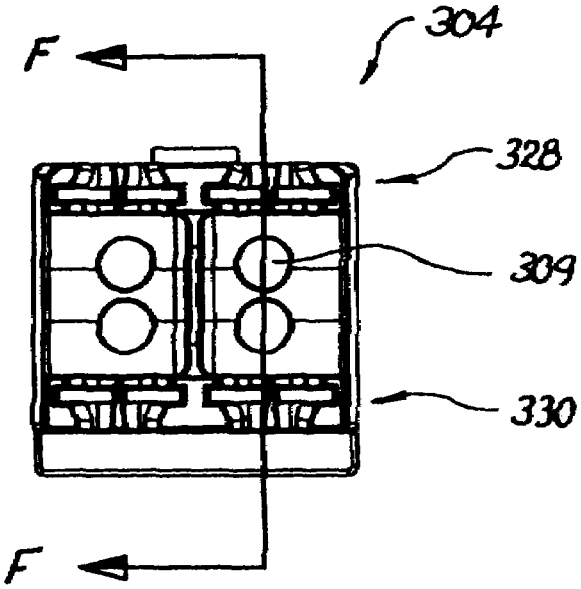
FIG. 25 is a front view of the wire containment cap of FIG. 21.
Figure 26:
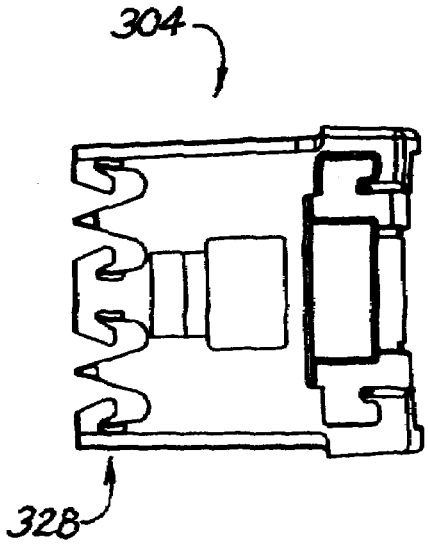
FIG. 26 is a top view of the wire containment cap of FIG. 21.
Figure 27:
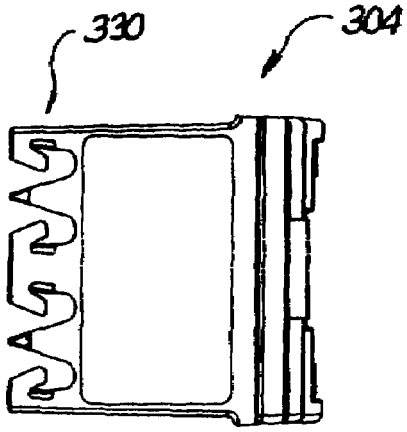
FIG. 27 is a bottom view of the wire containment cap of FIG. 21.
Figure 28:
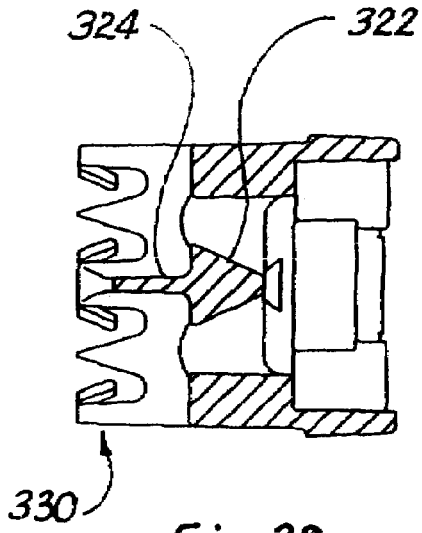
FIG. 28 is a cross-sectional view taken along the line E-E of FIG. 24.
Figure 29:
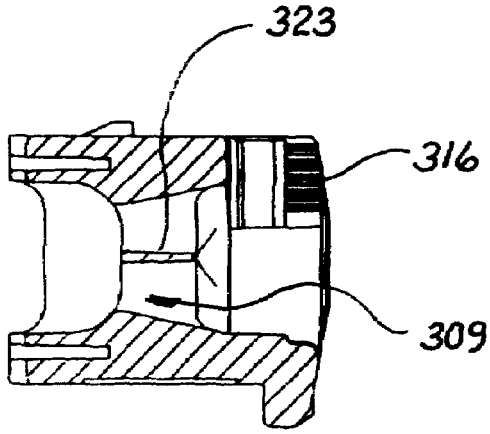
FIG. 29 is a cross-sectional view taken along the line F-F of FIG. 25.
Figure 30:
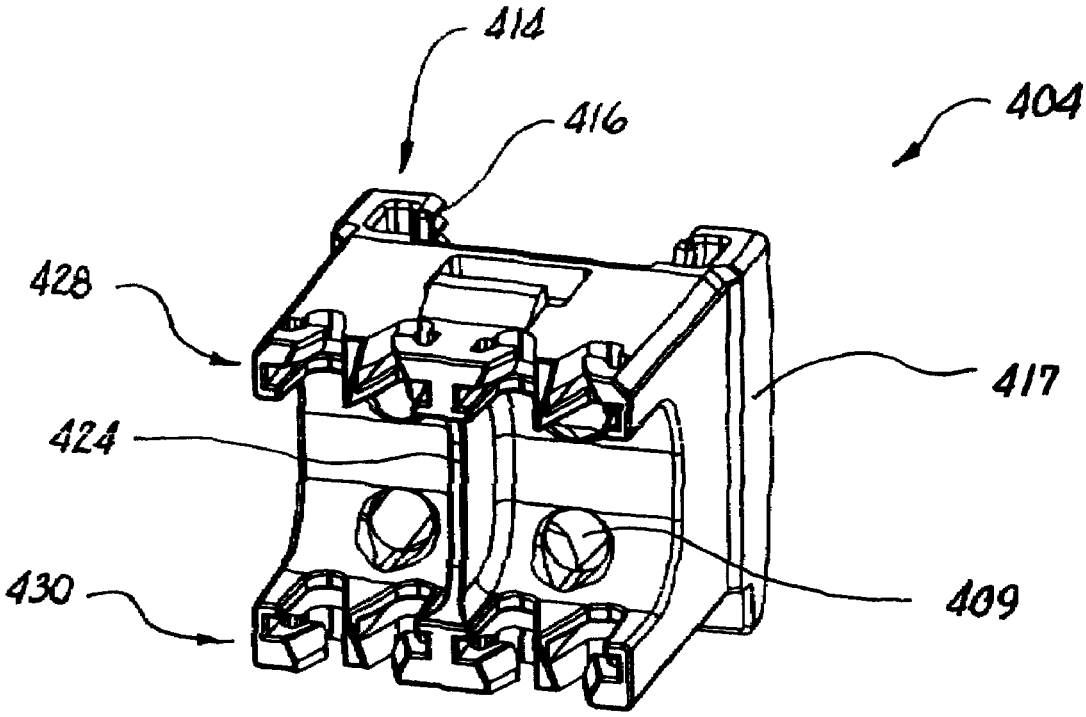
FIG. 30 is a front upper right perspective view of a wire containment cap according to one embodiment of the present invention.
Figure 31:
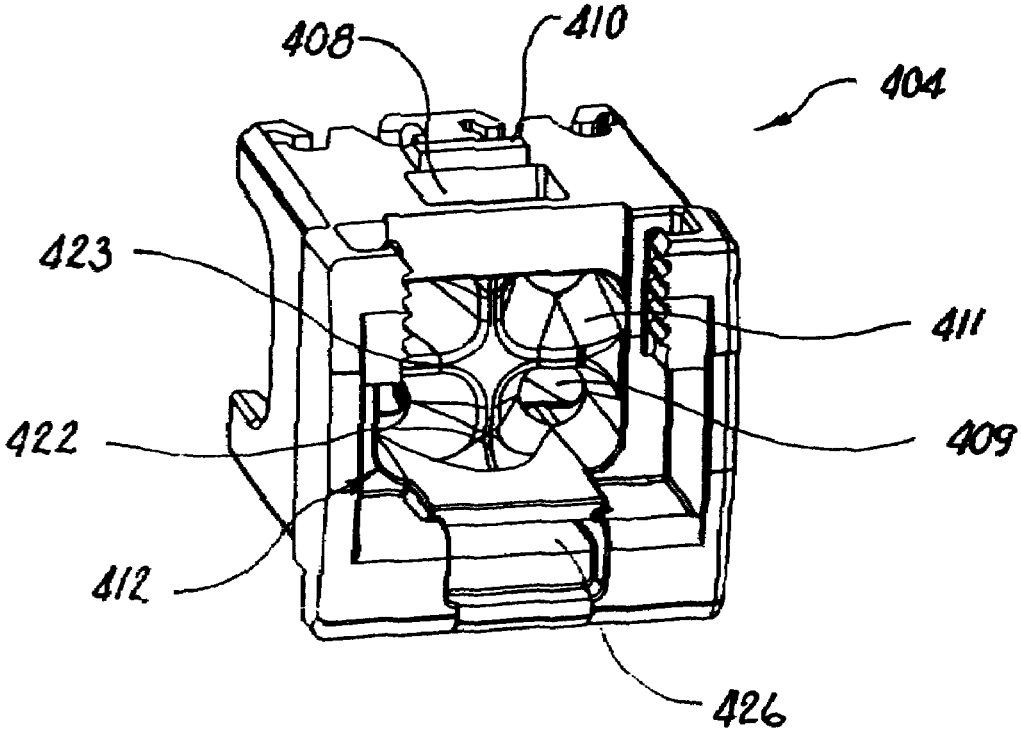
FIG. 31 is a rear upper right perspective view of the wire containment cap of FIG. 30.
Figure 32:
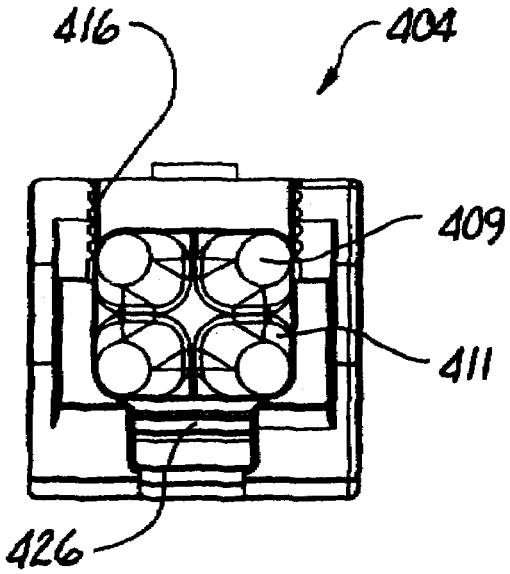
FIG. 32 is a rear view of the wire containment cap of FIG. 30.
Figure 33:
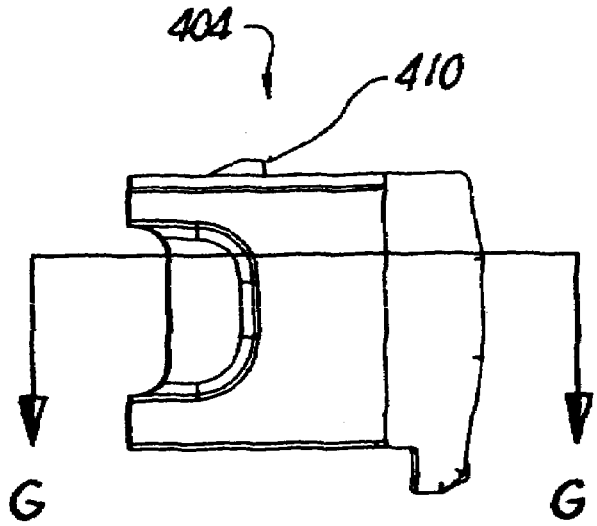
FIG. 33 is a right-side view of the wire containment cap of FIG. 30.
Figure 34:
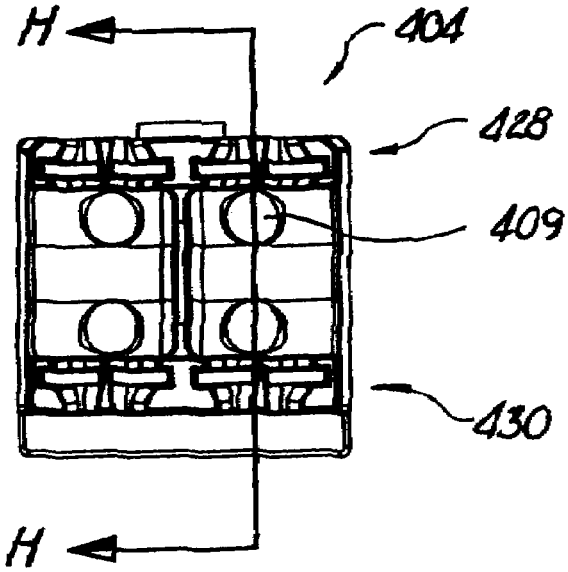
FIG. 34 is a front view of the wire containment cap of FIG. 30.
Figure 35:
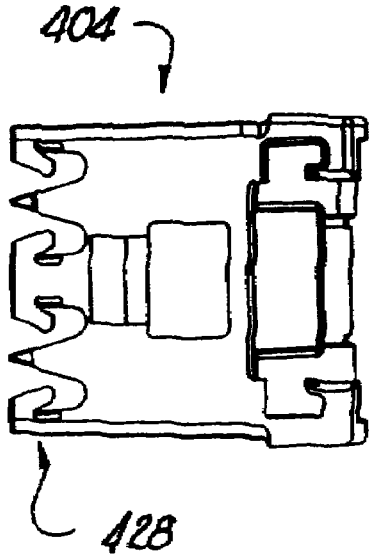
FIG. 35 is a top view of the wire containment cap of FIG. 30.
Figure 36:
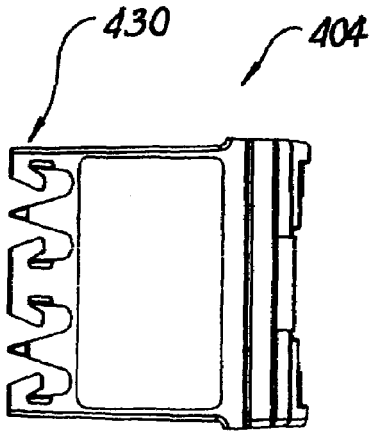
FIG. 36 is a bottom view of the wire containment cap of FIG. 30.
Figure 37:
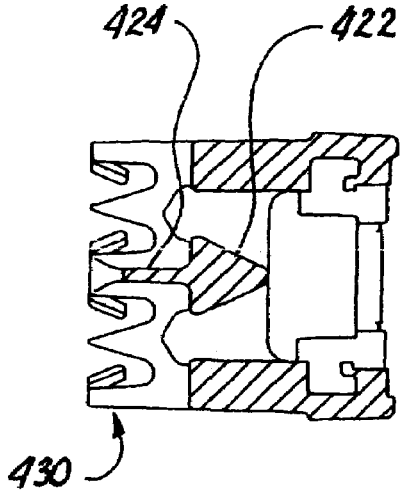
FIG. 37 is a cross-sectional view taken along the line G-G of FIG. 33.
Figure 38:
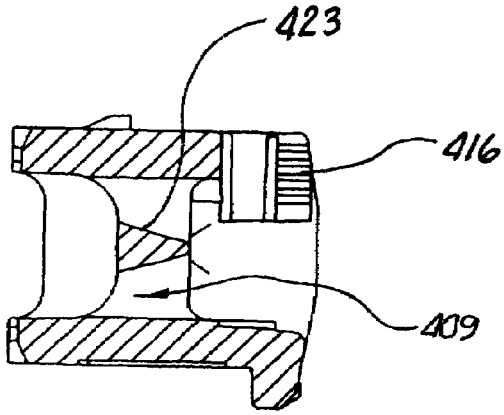
FIG. 38 is a cross-sectional view taken along the line H-H of FIG. 34.
Figure 39:
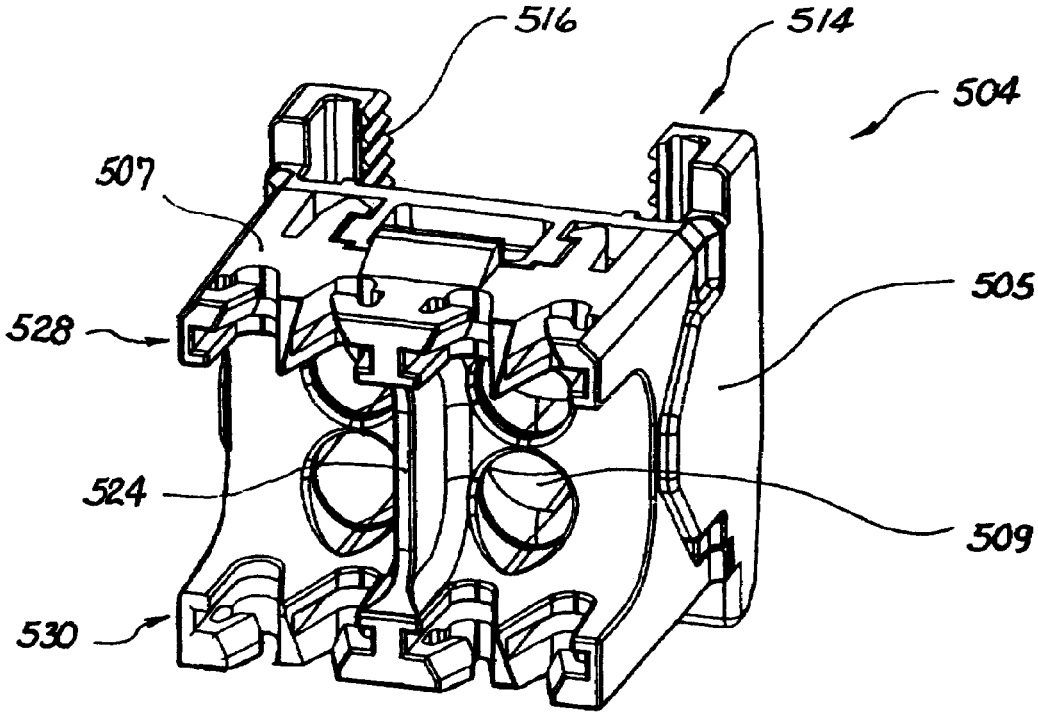
FIG. 39 is a front upper right perspective view of a shielded wire containment cap according to one embodiment of the present invention.
Figure 40:
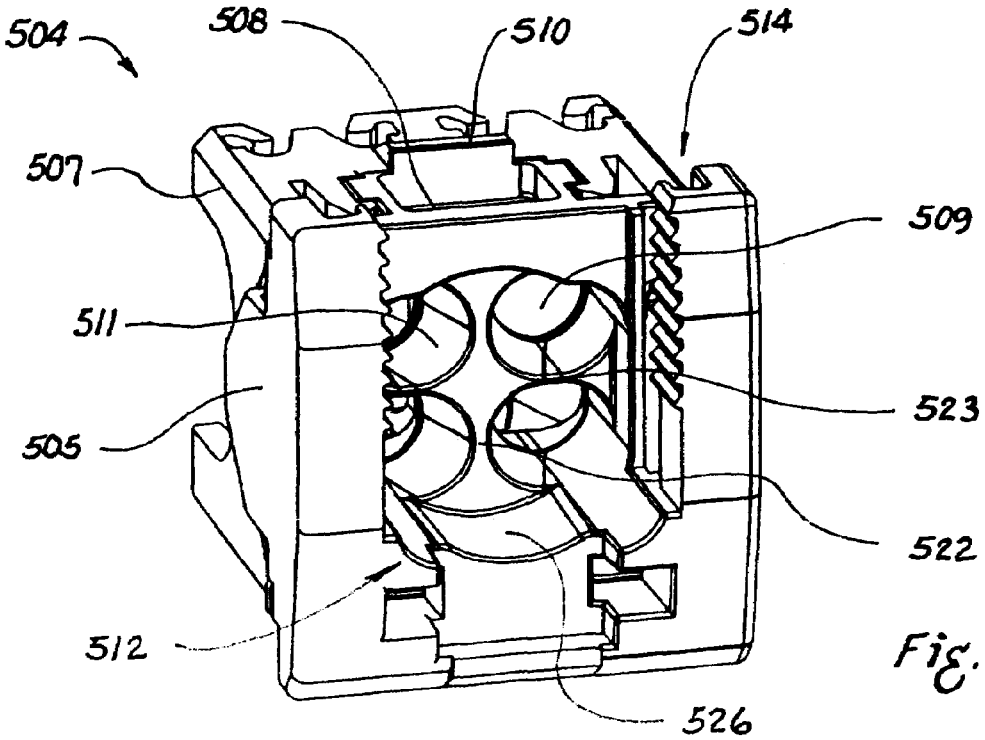
FIG. 40 is a rear upper right perspective view of the wire containment cap of FIG. 39.
Figure 41:
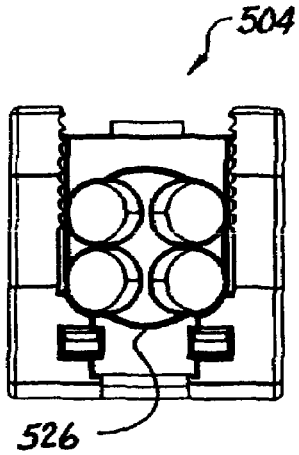
FIG. 41 is a rear view of the wire containment cap of FIG. 39.
Figure 42:
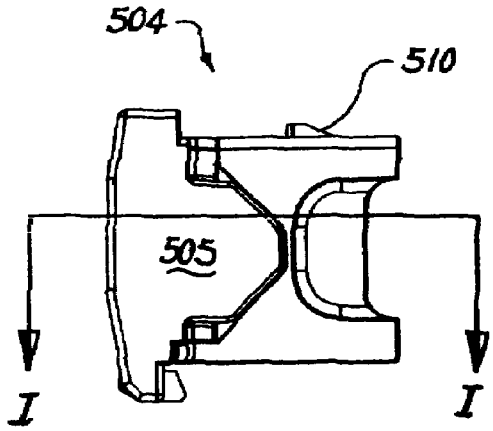
FIG. 42 is a left-side view of the wire containment cap of FIG. 39.
Figure 43:
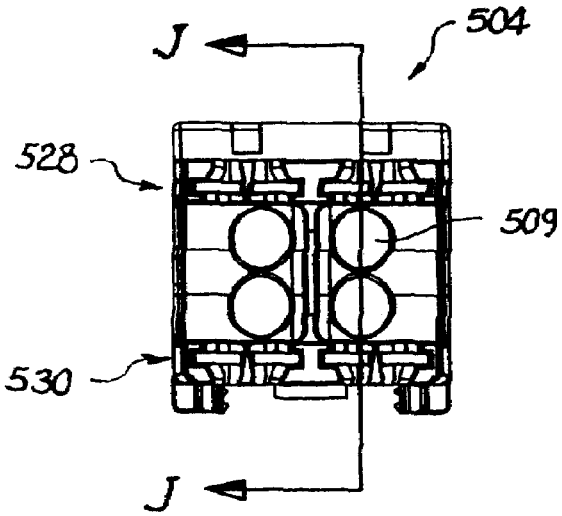
FIG. 43 is a front view of the wire containment cap of FIG. 39.
Figure 44:
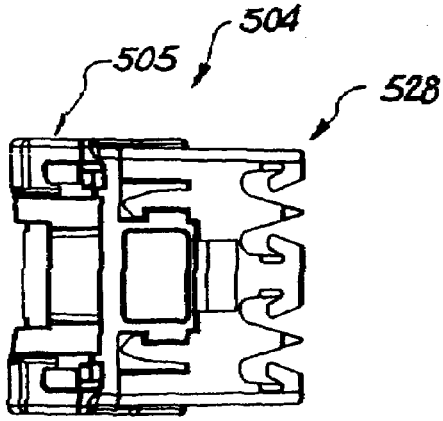
FIG. 44 is a top view of the wire containment cap of FIG. 39.
Figure 45:
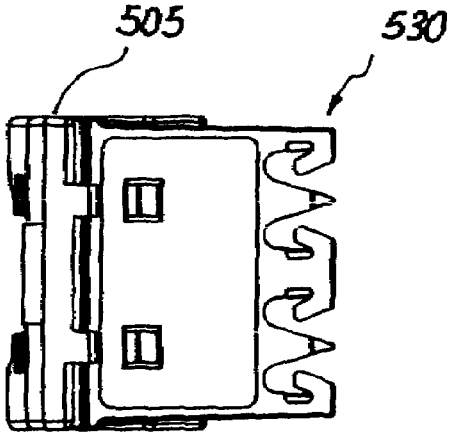
FIG. 45 is a bottom view of the wire containment cap of FIG. 39.
Figure 46:
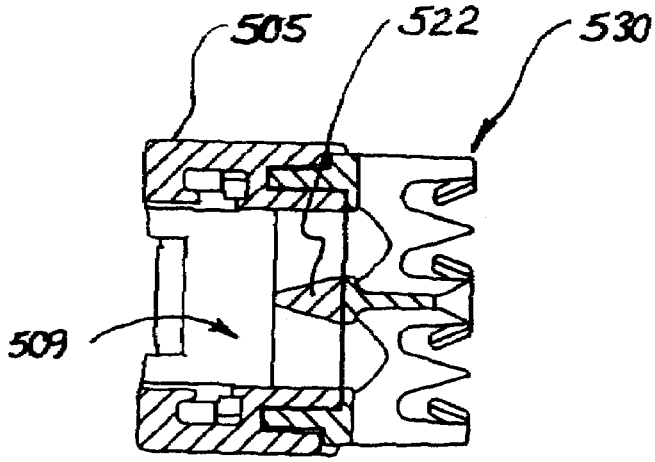
FIG. 46 is a cross-sectional view taken along the line I-I of FIG. 42.
Figure 47:
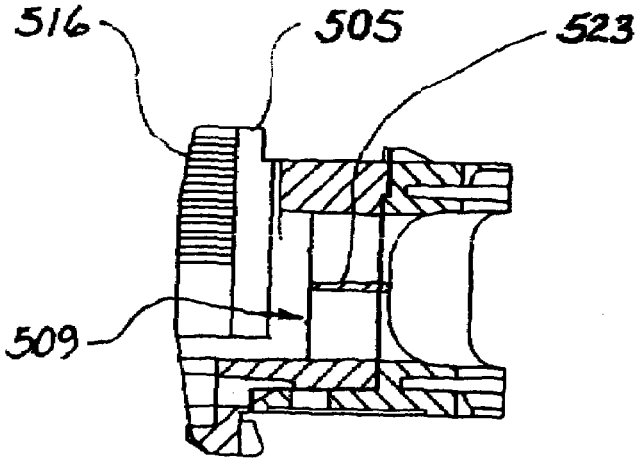
FIG. 47 is a cross-sectional view taken along the line J-J of FIG. 43.

Turning now to FIG. 12, a shielded wire containment cap 204 according to one embodiment of the present invention is shown. A rear portion 205 of the shielded wire containment cap 204 is constructed of metal. The metal portion comprises the rear portion of the strain relief guide slot 214, the strain relief latch teeth 216, and the saddle area 226. A front portion 207 of the shielded wire containment cap 204 is preferably constructed of plastic.

The slots 218 and the slot entrances 220 of the shielded wire containment cap 204 are larger than the slots 118 of the wire containment cap 104 to accommodate wires with larger diameters. The strain relief guide slot 214 and the saddle area 226 are also modified for use with shielded cable having a larger diameter than a cable used with the wire containment cap 104. Similarly to the wire containment cap 104, the region around the opening 212 in the rear of the shielded wire containment cap 204 and the setback of the rear spine 222 provides ample room for crossing-over of wires before the wires are inserted by an installer into the slots 218.

Additional details of the shielded wire containment cap 204 are shown in FIGS. 14-20, similarly to the illustrations of the wire containment cap 104 in FIGS. 5-11, above. Elements of the shielded wire containment cap 204—and of other wire containment caps, below—are numbered similarly to similar elements of the wire containment cap 104.

FIGS. 21-29 show a wire containment cap 304 with four closely-spaced wire-pair holes 309 for accepting wire pairs. Hole entrances 311 (shown in FIG. 22) are offset from a rear end of the wire containment cap 304 to provide room for an installer to cross-over necessary wire pairs before inserting the wire pairs into the hole entrances 311. The hole entrances 311 are preferably provided with funnel-shaped entrance surfaces. According to one embodiment, the holes 309 are sized to accept twisted pairs with conductor diameters of approximately 0.040 inches. A rear spine 322 and rear separator ribs 323 separate the hole entrances 311 from one another.

FIGS. 30-38 illustrate a wire containment cap 404 having four wire-pair holes 409 that are spaced farther apart at their front ends than the wire-pair holes 309 of the wire containment cap 304. According to one embodiment, the holes 409 are sized to accept twisted pairs with conductor diameters of approximately 0.040 inches. The hole entrances 411 of the wire containment cap 409 angle more sharply away from the center of the wire containment cap 409 than the hole entrances 311 of the wire containment cap 309 do. This forces wire pairs to exit the holes 409 closer to their corresponding upper and lower wire restraints 428 and 430 than the resulting placement of wires in the wire containment cap 309.

FIGS. 39-47 show a shielded wire containment cap 504 according to another embodiment of the present invention. The shielded wire containment cap 504 has four wire-pair holes 509 that are larger than the wire-pair holes 309 and 409, discussed above. The larger wire-pair holes 509 are for use with shielded cables having conductors with greater diameters. Similarly to the shielded wire containment cap 204, discussed above, the shielded wire containment cap 504 has a rear portion 505 constructed of metal. The strain relief guide slot 514 and the saddle area 526 are also modified for use with shielded cable.

The invention claimed is:

1. A wire containment cap for use with a communication connector, said wire containment cap having a rear end and a front end and comprising:

an opening near said rear end adapted to accept a communication cable, said opening having sufficient space therein to allow for separation of twisted wire pairs of said communication cable within said opening;

first and second twisted-pair slots adjacent to said opening, said twisted-pair slots having funnel-shaped slot entrances, each of said first and second twisted-pair slots being adapted to accept at least two of said twisted wire pairs of said communication cable and to route said twisted wire pairs toward the front end of the wire containment cap; and a rear spine separating said first and second twisted-pair slots to form said slot entrances, said opening extending between said rear end and an end of said real spine most proximate to said rear end, said rear spine extending from a first inner wall of said wire containment cap to an opposing second inner wall of said wire containment cap along substantially an entire length of said rear spine.

2. The wire containment cap of claim 1 further comprising shoulders forming a strain relief guide slot adapted to accept a strain relief clip such that the strain relief clip is slidable in said strain relief guide slot perpendicular to an insertion direction of the communication cable, strain relief latch teeth being located on the shoulders and adapted to latch a strain relief clip.

3. The wire containment cap of claim 2 further comprising a saddle area positioned at a lower end of said strain relief slot such that said lower end of said strain relief slot containing said saddle area is offset from an area of said lower end of said strain relief slot laterally adjacent to said lower end of said strain relief slot containing said saddle area in a direction perpendicular to the insertion direction of the communication cable, said saddle area adapted to serve as a lower support for said cable.

4. The wire containment cap of claim 1 wherein each of said first and second twisted pair slots has a width that is approximately the same as a width of a twisted wire pair.

5. The wire containment cap of claim 4 wherein each of said twisted pair slots has a height that is approximately double said width.

6. The wire containment cap of claim 1 further comprising a front spine located between said first and second twisted-pair slots, said front spine extending from said first and second twisted-pair slots to substantially said front end of said wire containment cap.

7. The wire containment cap of claim 1 further comprising upper and lower wire slots, each of said upper and lower wire slots having wire restraints adapted to hold individual wires of said communication cable.

8. The wire containment cap of claim 6 wherein said front spine extends front said first inner wall to said second inner wall along substantially an entire length of said front spine.

9. The wire containment cap of claim 6 wherein at a boundary between said rear spine and said front spine, said rear spine has a thickness greater than that of said front spine.

10. The wire containment cap of claim 1 further comprising rear separator ribs further separating pairs of said twisted-pair slots, said rear separator ribs extending from a third inner wall of said wire containment cap to an opposing fourth inner wall of said wire containment cap along an entire length of said rear separator ribs.

11. The wire containment cap of claim 1 wherein said rear spine increases in width with increasing distance from said rear end along substantially the entire length of said rear spine such that said slot entrances decrease in width with increasing distance from said rear end.

12. A wire containment cap for use with a communication connector, the wire containment cap having a rear end and a front end and comprising:

an opening near the rear end adapted to accept a communication cable, the opening having sufficient space therein to allow for separation of twisted wire pairs of the communication cable within the opening;

first and second twisted-pair slots adjacent to the opening, the twisted-pair slots having funnel-shaped slot entrances, each of the first and second twisted-pair slots being adapted to accept at least two of the twisted wire pairs of the communication cable and to route the twisted wire pairs toward the front end of the wire containment cap;

a rear spine separating the first and second twisted-pair slots; and a front spine extending from the first and second twisted-pair slots to substantially the front end of the wire containment cap and located between the first and second twisted-pair slots, wherein at a boundary between the rear spine and the front spine, the rear spine has a thickness greater than that of the front spine.

13. The wire containment cap of claim 12 wherein the front spine extends from an inner wall of the wire containment cap to an opposing inner wall of the wire containment cap along substantially an entire length of the front spine.

14. The wire containment cap of claim 12 further comprising shoulders forming a strain relief guide slot adapted to accept a strain relief clip such that the strain relief clip is slidable in the strain relief guide slot perpendicular to a direction of insertion of the communication cable, strain relief latch teeth being located on the shoulders and adapted to latch the strain relief clip.

15. The wire containment cap of claim 14 further comprising a saddle area positioned at a lower end of the strain relief slot such that the lower end of the strain relief slot containing the saddle area is offset from an area of the lower end of the strain relief slot laterally adjacent to the lower end of the strain relief slot containing the saddle area in a direction perpendicular to the insertion direction of the communication cable, the saddle area.

16. The wire containment cap of claim 12 wherein the rear spine increases in width with increasing distance from the rear end along substantially an entire length of the rear spine such that the slot entrances decrease in width with increasing distance from the rear end.

17. The wire containment cap of claim 12 further comprising rear separator ribs further separating pairs of the twisted-pair slots, the rear separator ribs extending from an inner wall of the wire containment cap to an opposing inner wall of the wire containment cap along an entire length of the rear separator ribs.

18. A wire containment cap for use with a communication connector, the wire containment cap having a rear end and a front end and comprising:

an opening near the rear end adapted to accept a communication cable, the opening having sufficient space therein to allow for separation of twisted wire pairs of the communication cable within the opening;

first and second twisted-pair slots adjacent to the opening, the twisted-pair slots having funnel-shaped slot entrances, each of the first and second twisted-pair slots being adapted to accept at least two of the twisted wire pairs of the communication cable and to route the twisted wire pairs toward the front end of the wire containment cap;

a rear spine separating the first and second twisted-pair slots to form the slot entrances, the opening extending between the rear end and an end of the rear spine most proximate to the rear end; and a strain relief guide slot and strain relief latch teeth both located near the rear end and adapted to respectively guide and latch a strain relief clip, the strain relief guide slot disposed such that a gap exists between the strain relief guide slot and the rear spine in a direction of insertion of the communication cable.

19. The wire containment cap of claim 18 further comprising shoulders forming the strain relief guide slot such that the strain relief clip is slidable in the strain relief guide slot perpendicular to the direction of insertion of the communication cable, the strain relief latch teeth located on the shoulders and adapted to latch the strain relief clip.

20. The wire containment cap of claim 19 further comprising a saddle area positioned at a lower end of the strain relief slot such that the lower end of the strain relief slot containing the saddle area is offset from an area of the lower end of the strain relief slot laterally adjacent to the lower end of the strain relief slot containing the saddle area in a direction perpendicular to the insertion direction of the communication cable, the saddle area.

21. The wire containment cap of claim 20 further comprising a front spine located between the first and second twisted-pair slots, the front spine extending from the first and second twisted-pair slots to substantially the front end of the wire containment cap, the front spine extending from an inner wall of the wire containment cap to an opposing inner wall of the wire containment cap along substantially an entire length of the front spine.

22. The wire containment cap of claim 21 wherein at a boundary between the rear spine and the front spine, the rear spine has a thickness greater than that of the front spine.

23. The wire containment cap of claim 18 further comprising rear separator ribs further separating pairs of the twisted-pair slots, the rear separator ribs extending from an inner wall of the wire containment cap to an opposing inner wall of the wire containment cap along an entire length of the rear separator ribs.

24. The wire containment cap of claim 18 wherein the rear spine increases in width with increasing distance from the rear end along substantially an entire length of the rear spine such that the slot entrances decrease in width with increasing distance from the rear end.

* * * * *

UNITED STATES PATENT AND TRADEMARK OFFICE

CERTIFICATE OF CORRECTION

PATENT NO. : 7,384,298 B2
APPLICATION NO. : 11/462204
DATED : June 10, 2008
INVENTOR(S) : Jack E. Caveney et al.

It is certified that error appears in the above-identified patent and that said Letters Patent is hereby corrected as shown below:

Col. 6, line 62, change “real” to -- rear --.

Signed and Sealed this

Eleventh Day of November, 2008

JON W. DUDAS
*Director of the United States Patent and Trademark Office*